US005146739A

United States Patent [19]

Lorenz

[11] Patent Number: 5,146,739

[45] Date of Patent: Sep. 15, 1992

[54] YARN FALSE TWIST TEXTURING PROCESS AND APPARATUS

[75] Inventor: Hellmut Lorenz, Remscheid, Fed. Rep. of Germany

[73] Assignee: Barmag AG, Remscheid, Fed. Rep. of Germany

[21] Appl. No.: 645,464

[22] Filed: Jan. 24, 1991

[30] Foreign Application Priority Data

Jan. 26, 1990 [DE] Fed. Rep. of Germany ..... 4002211
Feb. 17, 1990 [DE] Fed. Rep. of Germany ..... 4005074

[51] Int. Cl.[5] ..... D01H 7/92; D02G 1/06

[52] U.S. Cl. ..... 57/264; 57/282; 57/284; 57/288; 57/340

[58] Field of Search ..... 57/339, 340, 291, 287, 57/288, 284, 282, 264

[56] References Cited

U.S. PATENT DOCUMENTS

| | | | |
|---|---|---|---|
| 3,613,347 | 10/1971 | Carruthers | 57/264 X |
| 4,015,414 | 4/1977 | Sholly | 57/264 |
| 4,110,962 | 9/1978 | Shuster et al. | 57/339 |
| 4,144,700 | 3/1979 | Takai et al. | 57/264 |
| 4,145,871 | 3/1979 | Iwata et al. | 57/340 |
| 4,339,915 | 7/1982 | Dammann et al. | 57/339 |
| 4,383,405 | 5/1983 | Bauer et al. | 57/340 |
| 4,384,494 | 5/1983 | Taylor | 57/264 X |
| 4,424,664 | 1/1984 | Bauer et al. | 57/340 X |
| 4,445,322 | 5/1984 | Satterfield | 57/264 |
| 4,549,395 | 10/1985 | Dammann | 57/340 |
| 4,566,262 | 1/1986 | Schmucker | 57/264 |
| 4,720,702 | 1/1988 | Martens | 340/667 |

FOREIGN PATENT DOCUMENTS

| | | |
|---|---|---|
| 2130550 | 9/1972 | Fed. Rep. of Germany . |
| 3306594 | 1/1983 | Fed. Rep. of Germany . |

*Primary Examiner*—Daniel P. Stodola
*Assistant Examiner*—William Stryjewski
*Attorney, Agent, or Firm*—Bell, Seltzer, Park & Gibson

[57] ABSTRACT

A yarn false twist texturing process and apparatus wherein the tension of the advancing yarn is monitored. The resulting signal is processed through a time filter to produce a time averaged signal, and the time averaged signal is compared with a set point signal to produce an adjusting signal which acts to control the false twisting unit so as to provide a substantially constant tension. The adjusting signal is also used to detect deficiencies of the false twisting process which disturb the uniformity of the texturing process.

10 Claims, 2 Drawing Sheets

YARN FALSE TWIST TEXTURING PROCESS AND APPARATUS

BACKGROUND OF THE INVENTION

The present invention relates to a yarn false twist texturing process and apparatus, and which has provision for controlling the twist imparted to an advancing yarn, and so as to permit the production of yarn of high quality.

U.S. Pat. No. 4,339,915 to Dammann et al discloses a false twist texturing apparatus comprising a pair of rotating discs which are biased toward each other by means of a movable piston. German Patent DE 33 06 594 discloses a similar yarn false texturing apparatus wherein the twisting movement imparted to the yarn by the piston of the friction false unit is adjusted as function of the yarn tension. In such a process, there are several reasons why the yarn tension may be too high or too low, and one of these reasons is the fact that the frictional forces imparted to the yarn by the friction false twist unit may be too high or too low. To overcome this deficiency, the cited German patent discloses a method wherein the yarn tension is measured, and the measured signal is fed to a control device. The control device in turn controls the pressure exerted by the piston, and the pressure exerted by the piston is adjusted such that fluctuations of the yarn tension are minimized. A similar process is shown in U.S. Pat. No. 4,145,871 to Iwata et al in which the frictional forces are adjusted by adjusting the distance of the two discs between which the yarn is twisted.

The above prior processes have the advantage of providing a relatively uniform yarn tension, but they also have a disadvantage in that a uniform yarn tension overlies and hides many other deficiencies which may disturb the uniformity of the texturing process. Such other deficiencies occur, for example, as a result of the wear of a feed system or a malfunction of the temperature control of the texturing zone. U.S. Pat. No. 4,720,702 to Martens discloses the broad concept of utilizing the yarn tension and the mean value of the yarn tension as part of a process for monitoring deficiencies in a yarn false twist texturing operation. In this concept, the yarn tension is continuously monitored and the mean value of the monitored yarn tension is continuously determined together with the differential between the monitored value and the mean value, and an alarm signal is generated whenever the mean value leaves a predetermined tolerance range or whenever the differential value leaves a second predetermined tolerance range. One of the alarm signals as described above monitors one or more of the deficiencies disturbing the uniformity of the texturing process.

However, the method as per U.S. Pat. 4,720,702 for detecting deficiencies cannot be applied, if the above-mentioned methods as per German Patent 33 06 594 or U.S. Pat. No. 4,145,871 are applied, because in these methods, the frictional forces applied to the yarn are adjusted in such a way that, irrespective of the kind of deficiency, all fluctuations of the yarn tensions are eliminated. This means that the yarn tension has a more or less constant mean value and the possibility of using the mean value or its fluctuation for determining certain deficiencies no longer exists.

It is accordingly an object of the present invention to provide a yarn false twisting process and apparatus wherein the impartation of twist may be controlled by measuring the yarn tension, and which also permits the quality to be monitored by measuring the yarn tension.

SUMMARY OF THE INVENTION

In accordance with the present invention, it has been discovered that the above-mentioned disadvantage may be overcome by utilizing the input signal to the friction producing member of the false twist unit to generate the alarm signals, rather than using the mean value of the yarn tension. Analogous with the method as disclosed in U.S. Pat. No. 4,720,702 an alarm signal is generated, whenever the input signal to the friction false twist device for one of the advancing yarns leaves a predetermined tolerance range of input signals, or whenever the differential between the monitored value of the yarn tension and the input value to the friction false twist device for one of the advancing yarns leaves a second predetermined range.

Stated in other words, the present invention comprises a yarn false twisting process and apparatus for false twisting a yarn and which comprises the steps of feeding the advancing yarn through a false twist unit which acts to impart a frictional force to the yarn which has a twisting component and a tension imparting component, monitoring the tension of the advancing yarn and generating a signal (U) representative of the monitored tension, and processing the generated tension signal (U) through a time filter to produce a time averaged signal (MU). The time averaged signal (MU) is compared with a set point signal (Soll) and an adjusting signal (VS) is produced representing the difference therebetween. The adjusting signal (VS) is compared with the tension signal (U) and a differential signal (DU) is produced representing the difference therebetween. Also, an alarm signal is generated whenever (1) the adjusting signal (VS) leaves a predetermined range, and/or (2) the differential signal (DU) leaves a second predetermined range, and the operation of the false twist unit is controlled so that the frictional force imparted to the yarn varies as a function of the value of the adjusting signal (VS).

The operating principle of the friction false twist unit includes one or several moved surfaces which exert a frictional force on the yarn, and which has a twist imparting and a yarn tension producing component. The twist imparting component produces a torque on the yarn, thereby twisting same upstream when viewed in the direction of advance of the yarn. If the magnitude of the frictional force changes, for example, as a result of changing the coefficient of friction, both the twist imparting component and the yarn tension producing component will change, i.e., the change of the yarn tension has an indirect bearing on the intensity of the texturing process.

By experience, a few texturing defects, such as capillary breaks, tight spots and the density of the takeup packages are in a direct relationship with the yarn tension downstream of the twist unit. Consequently, a quality improving effect will occur, if the yarn tension is maintained within narrow, predetermined limits.

The present invention achieves the quality enhancing feature of a controlled yarn tension with a time-constant mean value, which is combined with the detection of changes in the frictional force, which is relevant for the quality.

To influence the twist transmission in accordance with one embodiment of the invention, provision is made to control the rotational speed of the friction false twist unit. In a corresponding layout of the geometry in the twist unit, this change will not substantially influence the twist impartation to the yarn as a result of this change (within certain limits). The quality enhancing effect of the substantially constant yarn tension will remain.

An influence of the yarn tension downstream of the twist unit is likewise possible via a geometric adjustment on the twist unit, for example, by a controlled change of the distance between axes of several rotating members.

In the case of a friction false twist unit which comprises two discs, and which clamp the yarn between them, note for example U.S. Pat. Nos. 4,145,781 and 4,339,915, it is preferred to change the contact pressure, as is proposed in the German Patent DE 33 06 594.

A friction false twist unit, which comprises three shafts arranged in the corners of an equilateral triangle with three discs clamped thereon, and which overlap in the center of the triangle, distinguishes itself in that the frictional force imparted to the advancing yarn may be controlled by varying the spacing between the shafts. It is possible to adjust the shafts in particular in that two shafts are supported in cams, which can be adjusted by a drive mechanism.

It is also known from the German Patent DE-33 06 594, to use the yarn tension signal for determining the operability of the texturing position, in that the measured signal of the yarn tension is supplied to a limit value signaler, which produces an output signal when certain maximum values and/or certain minimum values of the yarn tension are exceeded. However, in doing so, the significance of the measuring method defined in U.S. Pat. No. 4,720,702, in which the continuously measured value is related to the mean value, is not reached.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENT

Figure 1:
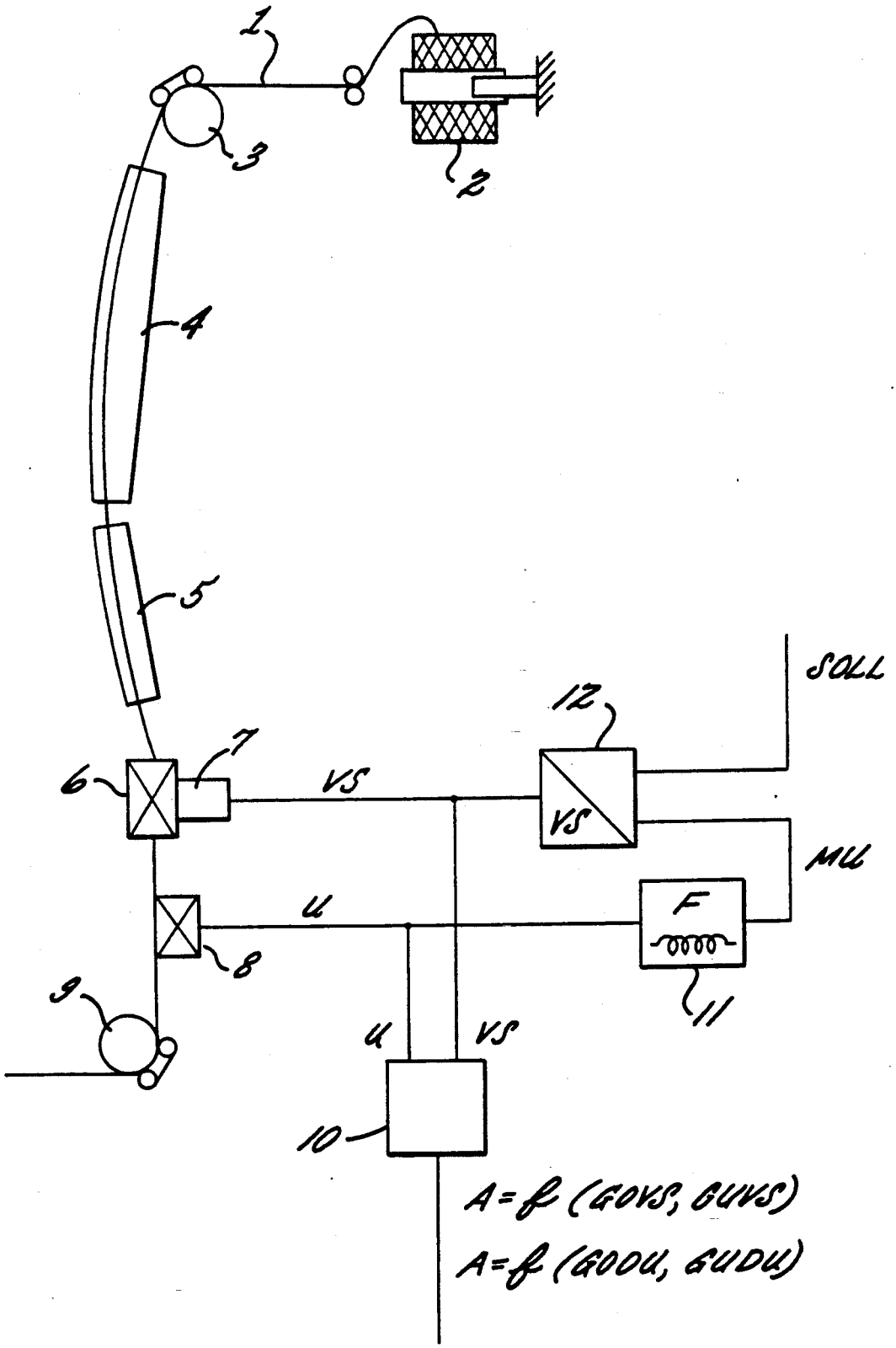
FIG. 1 is a schematic side elevation view of a yarn false twisting apparatus which embodies the features of the present invention.

FIG. 1 is a schematic illustration of one of the yarn processing stations of a false twist texturing machine. The manmade yarn 1 is unwound from a feed yarn package 2 by a feed system 3. The texturing zone is formed between the feed system 3 and a delivery system 9, and it comprises a heated plate 4, a cooling plate 5 and a friction false twist unit 6. The friction false twist unit has endlessly moved surfaces, which are moved transversely to the yarn axis, and contact the yarn. These surfaces impart to the yarn a twist in direction of the feed system, which twist is removed in the direction toward delivery system 9.

Between the friction false twist unit 6 and the delivery system 9 is positioned a yarn tension measuring instrument 8, which measures the yarn pull, referred to herein as "yarn tension", and which is converted to an output signal U which is representative of the measured tension. It should be noted that downstream of the feed system 9, the yarn is wound or undergoes an additional intermediate treatment by heating.

The output signal U of the instrument 8, which represents the measured yarn tension, is converted via a filter 11 to a long-term time averaged signal MU. The time averaged signal MU is supplied together with a set point value (Soll) to a controller 12. The controller 12 forms the differential between a preset value represented by the signal (Soll) and the time averaged signal MU, and then amplifies this difference to produce an adjusting signal VS. The adjusting signal VS adjusts a final control element 7, which in turn controls the impartation of the twist by the friction false twist unit 6 to the yarn.

The output signal U of the tension measuring instrument 8 is likewise supplied to an evaluation unit 10 as is the adjusting signal VS. The evaluation unit 10 supplies an evaluation of the actual output signal U, which represents the actually measured yarn tension according to the principles described in U.S. Pat. No. 4,720,702. This means that the evaluation unit 10 stores an upper limit value GOVS and a lower limit value GUVS. When the adjusting signal VS exceeds one of the limit values, an alarm signal is given. Further, in the evaluation unit 10 the differential value DU between the actual output signal U and the adjusting signal VS is formed, after the two have previously been converted to compatible, comparable quantities. Finally, the evaluation unit 10 stores the upper limit value GODU and the lower limit value GUDU of this differential signal DU. An alarm signal A is emitted, when the differential signal DU between the adjusting signal VS and the actually measured output signal U exceeds one of the limit values GODU, GUDU.

The adjusting device 7 may, for example, be the drive motor of the rotatable members of the friction false twist unit. In this instance, the differential signal from the time averaged signal and the set point value is converted in unit 12 to a quantity, for example, to a frequency, which determines the speed of the drive motor 7 of the friction false twist unit, which is designed as a synchronous motor or an asynchronous motor.

When the friction false twist unit comprises three shafts, which are arranged in the corners of an equal-sided triangle and accommodate discs which overlap in the center of the triangle, the adjusting device 7 allows to adjust alternatively or additionally the spacing between the shafts, in that, for example, the shafts are each supported in a cam, and that the cams are rotated as a function of the adjusting signal VS, note DE-AS 21 30 550.

Figure 2:
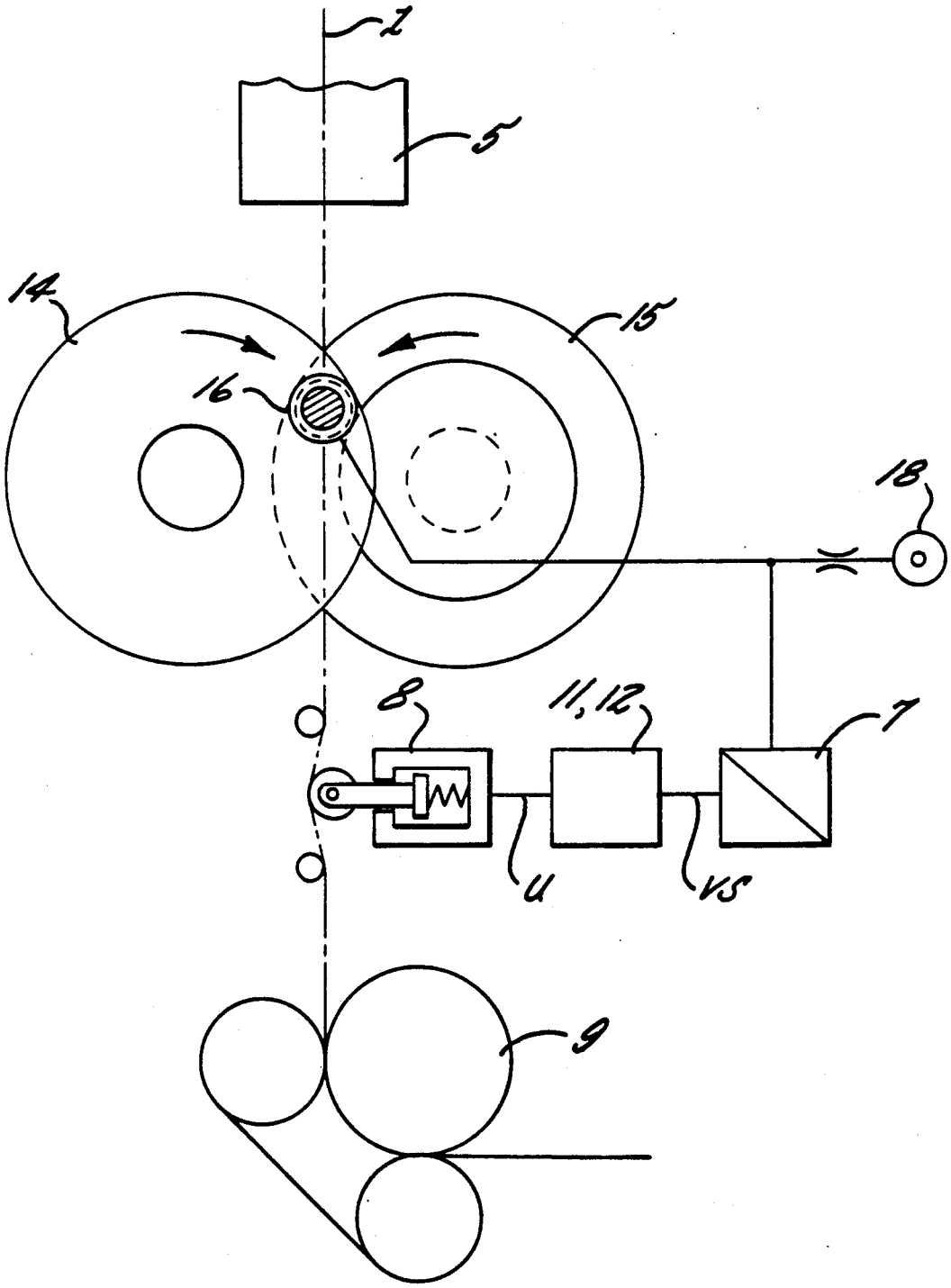
FIG. 2 is a schematic view of a false twisting unit in accordance with the present invention.

FIG. 2 illustrates one embodiment of a false twist unit in accordance with the present invention, and which comprises a pair of rotatable opposing discs 14, 15 which receive the advancing yarn 1 therebetween. The disc 14 is preferably thin and pliable, and a pressure applying piston 16 is mounted adjacent the back face of the pliable disc 14 for biasing the disc 14 toward the other disc 15 at the twisting zone. Pressurized air is delivered from a suitable source 18 into a cylinder which supports the piston 16, and serves to bias the piston toward the disc 14 with a controlled force. A further description of a false twisting unit of this type may be found in the above noted U.S. Pat. No. 4,339,915. In accordance with the present invention, the adjusting signal VS acts through the adjusting device 7 to adjust the pressure of the air supplied to the piston 16.

In the drawings and specification, there has been set forth a preferred embodiment of the invention, and although specific terms are employed, they are used in a generic and descriptive sense only and not for purposes of limitation.

That which is claimed is:

1. A yarn false twist texturing process having provision for controlling the twist imparted to an advancing yarn, and comprising the steps of feeding the advancing yarn through a false twist unit which acts to impart a frictional force to the yarn which has a twisting component ad a tension imparting component, monitoring the tension of the advancing yarn and generating a signal (U) representative of the monitored tension, processing the generated tension signal (U) through a time filter to produce a time averaged signal (MU), comparing the time averaged signal (MU) with a set point signal (Soll) and producing an adjusting signal (VS) representing the difference therebetween, comparing the adjusting signal (VS) with the tension signal (U) and producing a differential signal (DU) representing the difference therebetween, generating an alarm signal whenever at least one of the following conditions is present: (1) the adjusting signal (VS) leaves a predetermined range, and (2) the differential signal (DU) leaves a second predetermined range, and controlling the operation of the false twist unit so that the frictional force imparted to the yarn varies as a function of the value of the adjusting signal (VS).

2. The process as defined in claim 1 wherein the false twist unit comprises a plurality of rotatable members which engage the advancing yarn, and the controlling step includes controlling the rotational speed of the rotatable members.

3. The process as defined in claim 1 wherein the false twist unit comprises a plurality of rotatable members which engage the advancing yarn so as to define a contact pressure, and the controlling step includes adjusting the contact pressure between the advancing yarn and the members.

4. The process as defined in claim 1 wherein the step of monitoring the tension of the advancing yarn includes sensing the tension at a location immediately downstream of said false twist unit.

5. The process as defined in claim 1, wherein the false twist unit comprises a plurality of rotatable members which engage the advancing yarn and which includes means for adjusting the angular disposition of the direction of movement of the rotatable members, and wherein the step of controlling the operation of the false twist unit comprises adjusting the angular disposition of the direction of movement of the rotatable members.

6. An apparatus for false twist texturing an advancing yarn and comprising yarn false twisting means for imparting a frictional force to an advancing yarn which has a twisting component and a tension imparting component, sensor means positioned downstream of said yarn false twisting means for continuously monitoring the tension of the advancing yarn and generating a signal (U) representative of the tension, circuit means operatively connected to said sensor means for continuously determining a time averaged value (MMU) of the monitored tension signal (U), for also continuously comparing the time averaged value (MU) and a set point signal (Soll) and producing an adjusting signal (VS) representing the difference therebetween, and for also comparing the adjusting signal (VS) with the tension signal (U) and producing a differential signal (DU) representing the difference therebetween, means for generating an alarm whenever at least one of the following conditions is presents; (1) the adjusting signal (VS) leaves a predetermined range, and (2) the differential signal (DU) leaves a second predetermined range, and means for controlling the operation of the yarn false twisting means such that the frictional force imparted to the advancing yarn varies as a function of the value of the adjusting signal (VS).

7. The apparatus as defined in claim 6 wherein said yarn false twisting means comprises a pair of rotatable members adapted to engage the advancing yarn, and said means for controlling the operation of the false twisting means comprises means for controlling the rotational speed of said rotatable members.

8. The apparatus as defined in claim 6 wherein said yarn false twisting means comprises a pair of rotatable members adapted to engage the advancing yarn, and said means for controlling the operation of the false twisting means comprises means for controlling the frictional force between the rotatable members and the advancing yarn.

9. The apparatus as defined in claim 8 wherein said rotatable members comprise a pair of opposing discs adapted to receive the advancing yarn therebetween, and said means for controlling the frictional force comprises piston means for biasing the opposing discs toward each other under a controlled pressure.

10. The apparatus as defined in claim 6, wherein said yarn false twisting means comprises a pair of rotatable members adapted to engage the advancing yarn, and wherein said means for controlling the operation of the false twisting means comprises means for controlling the relative distance between said rotatable members.

* * * * *

UNITED STATES PATENT AND TRADEMARK OFFICE

CERTIFICATE OF CORRECTION

PATENT NO. : 5,146,739

DATED : September 15, 1992

INVENTOR(S) : Hellmut Lorenz

It is certified that error appears in the above-indentified patent and that said Letters Patent is hereby corrected as shown below:

Column 5, line 10, "ad" should be -- and --.

Column 6, line 12 "(MMU)" should be -- (MU) --.

Column 6, line 21, "presents" should be --present --.

Signed and Sealed this

Twenty-sixth Day of October, 1993

*Attest:*

*Attesting Officer*

BRUCE LEHMAN

*Commissioner of Patents and Trademarks*